US009786214B2

(12) United States Patent
Chen et al.

(10) Patent No.: US 9,786,214 B2
(45) **Date of Patent: *Oct. 10, 2017**

(54) LIQUID CRYSTAL PANEL AND PIXEL UNIT SETTING METHOD THEREOF

(71) Applicant: Shenzhen China Star Optoelectronics Technology Co., Ltd., Shenzhen, Guangdong (CN)

(72) Inventors: Lixuan Chen, Guangdong (CN); Chih-Tsung Kang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 100 days.

This patent is subject to a terminal disclaimer.

(21) Appl. No.: 14/435,461

(22) PCT Filed: Nov. 14, 2014

(86) PCT No.: PCT/CN2014/091130

§ 371 (c)(1),
(2) Date: Apr. 14, 2015

(87) PCT Pub. No.: WO2016/070455

PCT Pub. Date: May 12, 2016

(65) Prior Publication Data

US 2016/0335946 A1 Nov. 17, 2016

(30) Foreign Application Priority Data

Nov. 5, 2014 (CN) ..... 2014 1 0620800

(51) Int. Cl.
*G09G 3/20* (2006.01)
*G09G 3/36* (2006.01)

(52) U.S. Cl.
CPC ..... *G09G 3/2074* (2013.01); *G09G 3/3607* (2013.01); *G09G 3/3648* (2013.01);
(Continued)

(58) Field of Classification Search
CPC .. G09G 3/2074; G09G 3/3607; G09G 3/3685; G09G 2300/0452;
(Continued)

(56) References Cited

U.S. PATENT DOCUMENTS

2008/0036718 A1* 2/2008 Lee ..... G09G 3/3607 345/88
2010/0053052 A1* 3/2010 Shimoshikiryoh .. G09G 3/3607 345/89
2012/0268357 A1* 10/2012 Shih ..... G09G 3/3607 345/88

* cited by examiner

*Primary Examiner* — Jennifer Mehmood
*Assistant Examiner* — Parul Gupta

(57) ABSTRACT

Disclosed is a pixel unit setting method for a liquid crystal panel. The liquid crystal panel includes a plurality of pixel units, each of which includes at least a blue sub pixel. The method includes dividing the blue sub pixel into a main pixel zone and a sub pixel zone with the area ratio therebetween being a:b; acquiring actual brightness levels of the blue sub pixel for each grey level at a normal view angle and an oblique view angle; setting a combination of grey levels to be fed to the main and sub pixel zones of one pixel unit so as to have the sum of differences between the actual and theoretical brightness levels at the normal and oblique view angles minimized so as to obtain the grey levels to be fed to the main and sub pixel zones for all the grey levels of the pixel unit.

10 Claims, 2 Drawing Sheets

(52) U.S. Cl.
CPC ... *G09G 3/3685* (2013.01); *G09G 2300/0447* (2013.01); *G09G 2300/0452* (2013.01); *G09G 2310/027* (2013.01); *G09G 2320/0242* (2013.01); *G09G 2320/0276* (2013.01); *G09G 2320/0626* (2013.01)

(58) Field of Classification Search
CPC ..... G09G 2310/027; G09G 2320/0242; G09G 2320/0276; G09G 2320/0626
See application file for complete search history.

LIQUID CRYSTAL PANEL AND PIXEL UNIT SETTING METHOD THEREOF

CROSS REFERENCE TO RELATED APPLICATIONS

This application claims the priority of Chinese Patent Application No. 201410620800.3 , entitled "Liquid Crystal Panel and Pixel Unit Setting Method Thereof", filed on Nov. 20, 2014 , the disclosure of which is incorporated herein by reference in its entirety.

BACKGROUND OF THE INVENTION

1 . Field of the Invention

The present invention relates to the field of liquid crystal display technology, and in particular to a liquid crystal panel and a pixel unit setting method thereof.

2 . The Related Arts

A liquid crystal display, which is often referred to as LCD, is a displaying device in the form of an extremely thin flat panel and is composed of a predetermined number of color or monochrome pixels positioned in front of a light source or a reflector plate. The LCD has a low consumption of electrical power but shows characteristics of high image quality, small size, and reduced weight, all these making it favored by the public and becoming the main stream of the displaying devices. The liquid crystal display has been widely used in various electronic products, such as computing facility with screens, mobile phones, and digital photo frames. Wide view angle technology is one of the key issues of the current development of the liquid crystal display. However, when the view angle for sideway viewing or oblique viewing is large, color shift and light leakage often occur in the wide view angle liquid crystal displays.

To cope with the issue of color shift occurring in the wide view angle liquid crystal display, a common solution adopted in the industry to improve such an issue is referred to as 2D1G. The so-called 2D1G technique is that in a liquid crystal panel, each pixel unit is divided into a main pixel and a sub pixel that have different areas. The main pixel and the sub pixel of the same pixel unit are connected to different data lines but are connected to the same gate line. Through supplying different data signals (having different gray levels) to the main pixel and the sub pixel, different levels of displaying brightness and oblique viewing brightness are generated so as to reduce the color shift issue occurring in sideway viewing or oblique viewing. However, the division of each of the pixel units into a main pixel and a sub pixel would require the amount of the data lines that supply data signals to be doubled. This affects transmittance and reduces the displaying quality of the liquid crystal panel.

SUMMARY OF THE INVENTION

An object of the present invention is to provide a liquid crystal panel and a pixel unit setting method thereof, which reduce the influence on the transmittance and alleviate the color shift issue for sideway viewing and oblique viewing.

The present invention also provides a liquid crystal display.

A pixel unit setting method for a liquid crystal panel, where the liquid crystal panel comprises a plurality of pixel units, each of the pixel units at least comprising a blue sub pixel, the method comprising:

S10: dividing the blue sub pixel into a main pixel zone M and a sub pixel zone S, wherein an area ratio between the main pixel zone M and the sub pixel zone S is a:b;

S11: acquiring an actual brightness level Lvα for each grey level G of the blue sub pixel of the liquid crystal panel at a normal view angle α;

S12: acquiring an actual brightness level Lvβ for each grey level G of the blue sub pixel of the liquid crystal panel at an oblique view angle β;

S13: applying the following formulas to divide the actual brightness levels Lvα and Lvβ according to the area ratio between the main pixel zone M and the sub pixel zone S:

$$LvM\alpha:LvS\alpha=a:b,\ LvM\alpha+LvS\alpha=Lv\alpha;$$

$$LvM\beta:LvS\beta=a:b,\ LvM\beta+LvS\beta=Lv\beta;$$

acquiring actual brightness levels LvMα and LvMβ of the main pixel zone M for each grey level G at the normal view angle α and the oblique view angle β; and acquiring the actual brightness levels LvSα and LvSβ of the sub pixel zone S for each grey level G at the normal view angle α and the oblique view angle β;

S14: using the actual brightness levels Lvα(max) and Lvβ(max) of the maximum grey level max that are acquired in Steps S11 and S12, in combination with the formulas gamma(γ) and $(G/max)^{\gamma}=LvG/Lv(max)$, to calculate the theoretic brightness levels LvGxα and LvGxβ of the blue sub pixel of the liquid crystal panel for grey level G at the normal view angle α and the oblique view angle β;

S15: determining a grey level Gx of the blue sub pixel and grey levels to be fed to the main pixel zone M and the sub pixel zone S being respectively Gmx and Gsx, and applying the following formulas according to the actual brightness levels LvMα and LvMβ and LvSα and LvSβ acquired in Step S13 and the theoretic brightness levels LvGxα and LvGxβ acquired in Step S14:

$$\Delta 1=LvM\alpha+LvS\alpha-LvGx\alpha;\ \Delta 2=LvM\beta+LvS\beta-LvGx\beta;$$
$$y=\Delta 1^2+\Delta 2^2;$$

wherein when y is minimum, the corresponding grey levels Gmx and Gsx are set to be the grey levels to be fed to the main pixel zone M and the sub pixel zone S when the grey level of the blue sub pixel is the grey level Gx;

S16: repeating Step S15 for each grey level of the blue sub pixel of the pixel unit so as to acquire the grey levels to be fed to the main pixel zone M and the sub pixel zone S for all the grey levels of the pixel unit.

In the above method, the normal view angle α is 0° and the oblique view angle β is 30 to 80°.

In the above method, grey levels of the liquid crystal panel comprise 256 grey levels from 0 to 255 of which a highest grey level is 255.

In the above method, the step of acquiring the actual brightness level Lvα of the blue sub pixel of the liquid crystal panel for each grey level G at the normal view angle α comprises:

directly measuring the gamma curve at the normal view angle α; and determining the actual brightness level Lvα from the gamma curve.

In the above method, the step of acquiring the actual brightness level of the blue sub pixel of the liquid crystal panel for each grey level G at the oblique view angle β comprises:

directly measuring the gamma curve Lvβ at the oblique view angle β; and determining the actual brightness level Lvβ from the gamma curve.

In the above method, the pixel unit further comprises a red sub pixel and a green sub pixel, and data signals of the red sub pixel and the green sub pixel are kept unchanged during the resetting of data parameters of the blue sub pixel.

In the above method, the main pixel zone M and the sub pixel zone S of the blue sub pixel are individually connected to data lines that supply data signals.

In the above method, for the main pixel zone M and the sub pixel zone S in the brightness curve Gamma (γ) at the oblique view angle, γ=2.2.

A pixel unit setting method for a liquid crystal panel, where the liquid crystal panel comprising a plurality of pixel units, each of the pixel units at least comprising a blue sub pixel, a red sub pixel, and a green sub pixel, the method comprising:

dividing the blue sub pixel into a main pixel zone M and a sub pixel zone S according to a predetermined area ratio;

acquiring actual brightness levels of each grey level G of the blue sub pixel of the liquid crystal panel at a normal view angle α and an oblique view angle β;

dividing the actual brightness levels according to the area ratio of the main pixel zone M and the sub pixel zone S and establishing a corresponding relationship between the grey levels and the actual brightness levels of the main pixel zone M and the sub pixel zone S; and acquiring the actual brightness levels of the highest grey levels and calculating a theoretic brightness level of each grey level, and setting a grey level combination fed to the main pixel zone M and the sub pixel zone S of one of the pixel units so that a sum of differences between the actual brightness levels and the theoretic brightness levels of the pixel at the normal view angle and the oblique view angle is minimized.

The present invention also provides a liquid crystal display, which comprises a backlight module and a liquid crystal panel opposite to the backlight module, the backlight module supplying light to the liquid crystal panel, the liquid crystal panel comprising a plurality of the pixel units, wherein each of the pixel units at least comprises a blue sub pixel; a method for the liquid crystal panel to set the pixel units comprises:

S10: dividing the blue sub pixel into a main pixel zone M and a sub pixel zone S, wherein an area ratio between the main pixel zone M and the sub pixel zone S is a:b;

S11: acquiring an actual brightness level Lvα for each grey level G of the blue sub pixel of the liquid crystal panel at a normal view angle α;

S12: acquiring an actual brightness level Lvβ for each grey level G of the blue sub pixel of the liquid crystal panel at an oblique view angle β;

S13: applying the following formulas to divide the actual brightness levels Lvα and Lvβ according to the area ratio between the main pixel zone M and the sub pixel zone S:

$$LvM\alpha:LvS\alpha=a:b,\ LvM\alpha+LvS\alpha=Lv\alpha;$$

$$LvM\beta:LvS\beta=a:b,\ LvM\beta+LvS\beta=Lv\beta;$$

acquiring actual brightness levels LvMα and LvMβ of the main pixel zone M for each grey level G at the normal view angle α and the oblique view angle β; and acquiring the actual brightness levels LvSα and LvSβ of the sub pixel zone S for each grey level G at the normal view angle α and the oblique view angle β;

S14: using the actual brightness levels Lvα(max) and Lvβ(max) of the maximum grey level max that are acquired in Steps S11 and S12, in combination with the formulas gamma(γ) and $(G/max)^{\gamma}=LvG/Lv(max)$, to calculate the theoretic brightness levels LvGxα and LvGxβ of the blue sub pixel of the liquid crystal panel for grey level G at the normal view angle α and the oblique view angle β;

S15: determining a grey level Gx of the blue sub pixel and grey levels to be fed to the main pixel zone M and the sub pixel zone S being respectively Gmx and Gsx, and applying the following formulas according to the actual brightness levels LvMα and LvMβ and LvSα and LvSβ acquired in Step S13 and the theoretic brightness levels LvGxα and LvGxβ acquired in Step S14:

$$\Delta1=LvM\alpha+LvS\alpha-LvGx\alpha;\ \Delta2=LvM\beta+LvS\beta-LvGx\beta;$$
$$y=\Delta1^2+\Delta2^2;$$

wherein when y is minimum, the corresponding grey levels Gmx and Gsx are set to be the grey levels to be fed to the main pixel zone M and the sub pixel zone S when the grey level of the blue sub pixel is the grey level Gx;

S16: repeating Step S15 for each grey level of the blue sub pixel of the pixel unit so as to acquire the grey levels to be fed to the main pixel zone M and the sub pixel zone S for all the grey levels of the pixel unit.

In the above, the liquid crystal panel further comprises a gate controller and a source controller, the gate controller supplying gate signals through a plurality of gate lines to the pixel units, the source controller supplying data signals through a plurality of data lines to the pixel units.

The present invention is devised to divide the blue sub pixel of the conventional three-pixel RGB liquid crystal panel into two different main pixel zone M and sub pixel zone S, while keeping the data signals R and G of the red sub pixel and the green sub pixel unchanged and to reset data parameters. The main pixel zone M and the sub pixel zone S are respectively connected to data signal lines to supply different data signals to the main pixel zone M and the sub pixel zone S in order to improve the issue of color shift at a large view angle. Compared to the red sub pixel and the green sub pixel, the blue pixel has least influence on the brightness and after resetting the grey levels, the potential risk of affecting the transmittance is reduced.

BRIEF DESCRIPTION OF THE DRAWINGS

To more clearly explain the technical solution proposed in an embodiment of the present invention and that of the prior art, brief descriptions of the drawings that are necessary for describing the embodiment or the prior art are given as follows. It is obvious that the drawings that will be described below show only some embodiments of the present invention. For those having ordinary skills of the art, other drawings may also be readily available from these attached drawings without the expense of creative effort and endeavor.

DETAILED DESCRIPTION OF THE PREFERRED EMBODIMENTS

A clear and complete description will be given to technical solutions of embodiments of the present invention with reference to the attached drawings of the embodiments of the present invention. However, the embodiments so described are only some, but not all, of the embodiments of the present invention. Other embodiments that are available to those having ordinary skills of the art without the expense of creative effort and endeavor are considered belonging to the scope of protection of the present invention.

Figure 1:
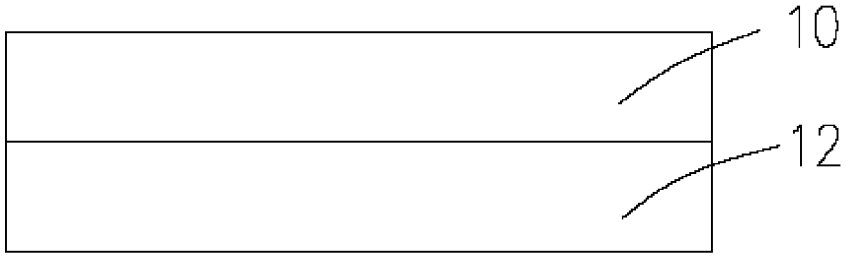
FIG. 1 is a schematic view showing the structure of a liquid crystal display according to an embodiment of the present invention.
Figure 2:
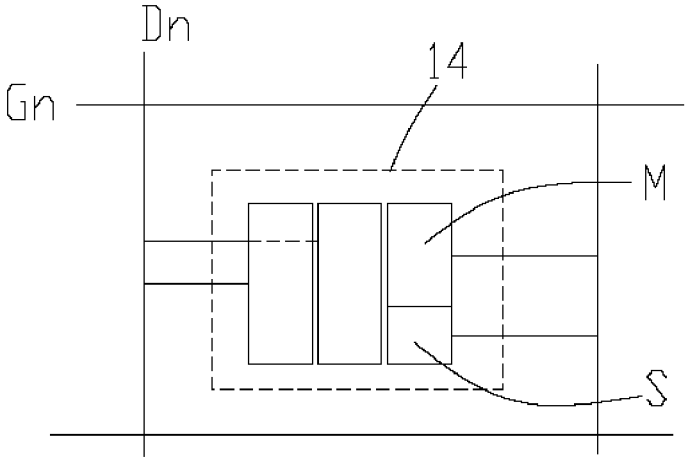
FIG. 2 is a schematic plan view showing a portion of pixel units of a liquid crystal panel according to an embodiment of the present invention.
Figure 3:
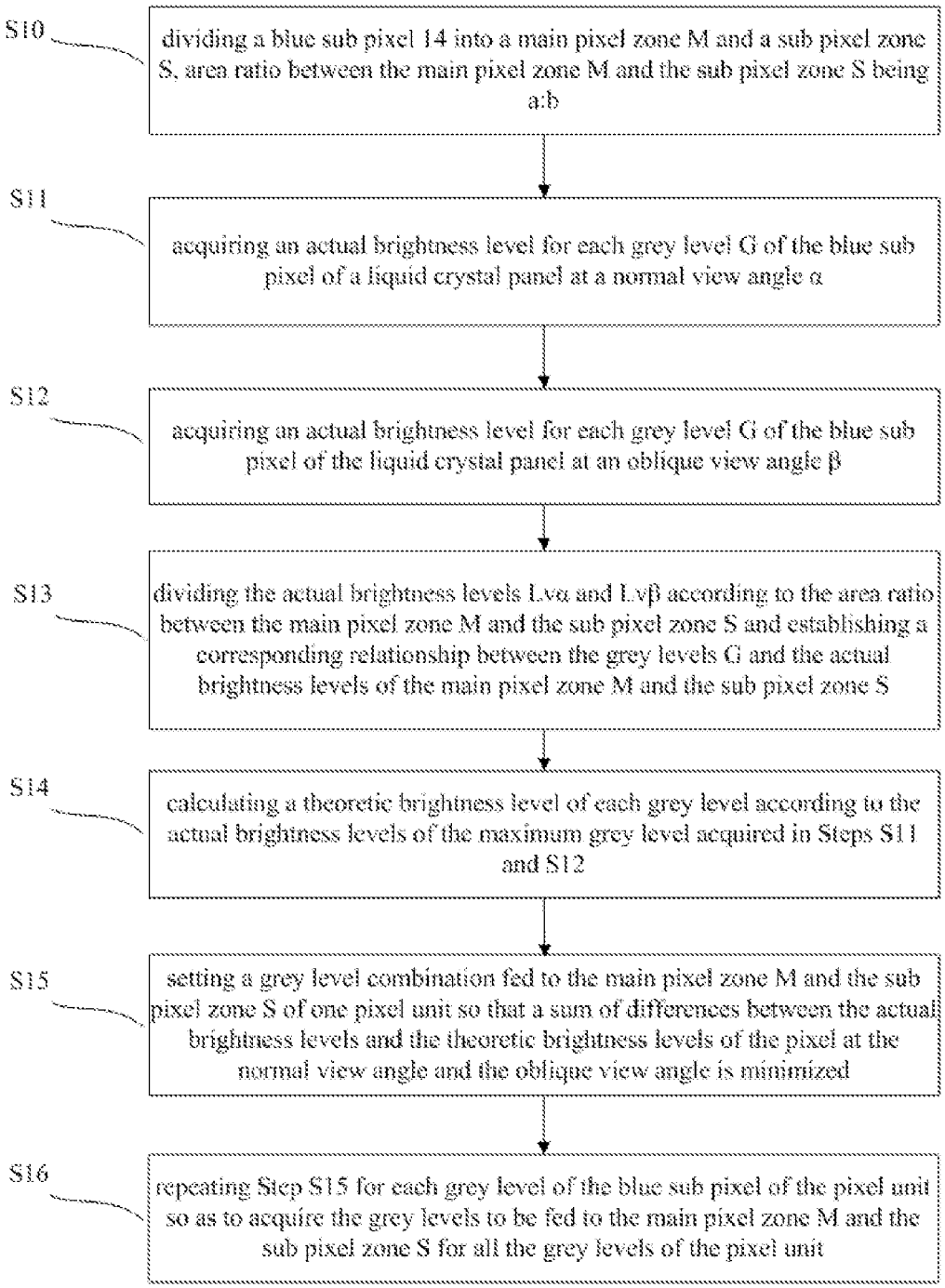
FIG. 3 is a flow chart illustrating a grey level setting method according to an embodiment of the present invention.

Referring to FIGS. 1 and 3, the present invention provides a liquid crystal display, which comprises a backlight module 10 and a liquid crystal panel 12 opposite to the backlight module 10. The backlight module 10 supplies light to the liquid crystal panel 12. The liquid crystal panel 12 comprises a plurality of pixel units 14. Each of the pixel units at least comprises a blue sub pixel, a red sub pixel, and a green sub pixel. A method for setting each of the pixel units comprises:

dividing the blue sub pixel into a main pixel zone M and a sub pixel zone S according to a predetermined area ratio;

acquiring actual brightness levels of each grey level G of the blue sub pixel of the liquid crystal panel at a normal view angle α and an oblique view angle β;

dividing the actual brightness levels according to the area ratio of the main pixel zone M and the sub pixel zone S and establishing a corresponding relationship between the grey levels and the actual brightness levels of the main pixel zone M and the sub pixel zone S;

acquiring the actual brightness levels of the highest grey levels and calculating a theoretic brightness level of each grey level, and setting a grey level combination fed to the main pixel zone M and the sub pixel zone S of one of the pixel units so that a sum of differences between the actual brightness levels and the theoretic brightness levels of the pixel at the normal view angle and the oblique view angle is minimized.

In the instant embodiment, each of the pixel units at least comprises a blue sub pixel. For the liquid crystal panel, the instant embodiment provides a method for setting the pixel units, which is generally applicable to setting the grey level of the blue sub pixel. The method comprises:

Step S10: dividing the blue sub pixel 14 into a main pixel zone M and a sub pixel zone S, wherein an area ratio between the main pixel zone M and the sub pixel zone S is a:b;

Step S11: acquiring an actual brightness level Lvα for each grey level G of the blue sub pixel of the liquid crystal panel at a normal view angle α;

Step S12: acquiring an actual brightness level Lvβ for each grey level G of the blue sub pixel of the liquid crystal panel at an oblique view angle β;

Step S13: applying the following formulas to divide the actual brightness levels Lvα and Lvβ according to the area ratio between the main pixel zone M and the sub pixel zone S:

$$LvM\alpha:LvS\alpha=a:b,\ LvM\alpha+LvS\alpha=Lv\alpha;$$

$$LvM\beta:LvS\beta=a:b,\ LvM\beta+LvS\beta=Lv\beta;\ \text{and}$$

acquiring actual brightness levels LvMα and LvMβ of the main pixel zone M for each grey level G at the normal view angle α and the oblique view angle β; and acquiring the actual brightness levels LvSα and LvSβ of the sub pixel zone S for each grey level G at the normal view angle α and the oblique view angle β;

Step S14: using the actual brightness levels Lvα(max) and Lvβ(max) of the maximum grey level max that are acquired in Steps S11 and S12, in combination with the formulas gamma(γ) and $(G/max)^{\gamma}=LvG/Lv(max)$, to calculate the theoretic brightness levels LvGxα and LvGxβ of the blue sub pixel of the liquid crystal panel for grey level G at the normal view angle α and the oblique view angle β;

Step S15: determining a grey level Gx of the blue sub pixel and grey levels to be fed to the main pixel zone M and the sub pixel zone S being respectively Gmx and Gsx, and applying the following formulas according to the actual brightness levels LvMα and LvMβ and LvSα and LvSβ acquired in Step S13 and the theoretic brightness levels LvGxα and LvGxβ acquired in Step S14:

$$\Delta 1=LvM\alpha+LvS\alpha-LvGx\alpha;\ \Delta 2=LvM\beta+LvS\beta-LvGx\beta;\ y=\Delta 1^2+\Delta 2^2;$$

wherein when y is minimum, the corresponding grey levels Gmx and Gsx are set to be the grey levels to be fed to the main pixel zone M and the sub pixel zone S when the grey level of the blue sub pixel is the grey level Gx;

Step S16: repeating Step S15 for each grey level of the blue sub pixel of the pixel unit so as to acquire the grey levels to be fed to the main pixel zone M and the sub pixel zone S for all the grey levels of the pixel unit.

The main pixel zone M and the sub pixel zone S can be divided by using a black matrix or by using a non-light-transmittable metal line.

The liquid crystal panel 12 further comprises a gate controller and a source controller. The gate controller supplies gate signals through a plurality of gate lines G to the pixel units. The source controller supplies data signals through a plurality of data lines D to the pixel units.

Further, for the main pixel zone M and the sub pixel zone S in the brightness curve Gamma (γ) at the oblique view angle, γ=2.2.

Further, in the instant embodiment, the normal view angle α is 0° and the oblique view angle β is 60°. In other embodiments, the oblique view angle β can be selected from the range of 30-80°.

In the instant embodiment, the grey levels of the liquid crystal panel include 256 grey levels from 0 to 255 , of which the highest grey level is 255.

Further, the step of acquiring the actual brightness level Lvα of the blue sub pixel of the liquid crystal panel for each grey level G at the normal view angle α comprises:

directly measuring the gamma curve at the normal view angle α; and determining the actual brightness level Lvα from the gamma curve.

Further, the step of acquiring the actual brightness level of the blue sub pixel of the liquid crystal panel for each grey level G at the oblique view angle β comprises:

directly measuring the gamma curve Lvβ at the oblique view angle β; and determining the actual brightness level Lvβ from the gamma curve.

In other embodiment of the present invention, Step 13 of acquiring the actual brightness levels LvMα and LvMβ of the main pixel zone M for each grey level G at the normal view angle α and the oblique view angle β; and acquiring the actual brightness levels LvSα and LvSβ of the sub pixel zone S for each grey level G at the normal view angle α and the oblique view angle β can be carried out with the following process:

first acquiring a relationship curve $G_0$-Lvα$G_0$ between the actual brightness level and the grey level of the blue sub pixel of the liquid crystal panel at the normal view angle α and then look up the values of LvMα and LvSα from the relationship curve $G_0$-Lvα$G_0$; and first acquiring a relationship curve $G_0$-Lvβ$G_0$ between the actual brightness level and the grey level of the blue sub pixel of the liquid crystal panel at the oblique view angle β and then look up the values of LvMβ and LvSβ from the relationship curve $G_0$-Lvβ$G_0$.

Considering the example, where the area ratio between the main pixel zone M and the sub pixel zone S is selected to be a:b=2:1, γ=2.2 in the Gamma (γ) curve, the normal view angle α=0°, and the oblique view angle β=60°, a detailed description of dividing the grey levels of the main pixel zone M and the sub pixel zone S according to the method of the present invention will be given.

Gamma (γ) curve of the liquid crystal panel at the normal view angle α=0° and the oblique view angle β=60° is first obtained and the actual brightness levels Lv0(0-255) and Lv60(0-255) for each grey level G are determined for the normal view angle 0° and the oblique view angle 60°.

Then, according to the area ratio of the main pixel zone M and the sub pixel zone S being a:b=2:1 , the actual brightness levels Lv0(0-255) and Lv60(0-255) are divided into LvM0 and LvM60 and LvS0 and LvS60, which satisfy the following relationships:

$$LvM0:LvS0=2:1, LvM0+LvS0=Lv0$$

$$LvM60:LvS60=2:1, LvM60+LvS60=Lv60$$

The actual brightness levels LvM0(0-255) and LvM60(0-255) of the main pixel zone M at the normal view angle 0° and the oblique view angle 60° for each grey level G are acquired. The actual brightness levels LvS0(0-255) and LvS60(0-255) of the sub pixel zone S at the normal view angle 0° and the oblique view angle 60° for each grey level G are acquired. Corresponding relationships between the grey levels G and the actual brightness levels of the main pixel zone M and the sub pixel zone S are established.

Next, according to the actual brightness levels Lv0(255) and Lv60(255) of the highest grey level 255 , in combination with gamma(γ)=2.2 and $(G/255)^{\gamma}$=LvG/Lv(255), the theoretic brightness levels of the blue sub pixel of the liquid crystal panel at the normal view angle α and the oblique view angle β for the grey level G are calculated to be LvG0(0-255) and LvG60(0-255).

Finally, one grey level Gx (one of 0-255) of the blue sub pixel is determined and the grey levels to be fed to the main pixel zone M and the sub pixel zone S are respectively Gmx and Gsx. According to the corresponding relationships between the grey levels G and the actual brightness levels of the pixel zone M and the sub pixel zone S, LvM0, LvM60, LvS0, LvS60 are obtained and according to the above theoretic brightness levels, LvGx0 and LvGx60 are obtained and the following equations are calculated:

$$\Delta 1=LvM0+LvS0-LvGx0;\ \Delta 2=LvM60+LvS60-LvGx06;\ y=\Delta 1^2+\Delta 2^2;$$

Through multiple times of trial for value combination of Gmx and Gsx, when the combination makes the above value of y minimum, grey levels Gmx and Gsx are set to be the grey levels to be fed to the main pixel zone M and the sub pixel zone S when the blue sub pixel has the grey level Gx.

Finally, the above steps are repeated for each of the grey levels of the blue sub pixel of the pixel units so as to acquire the grey levels to be fed to the main pixel zone M and the sub pixel zone S for all the grey level (0-255) of the pixel units.

The present invention is devised to divide the blue sub pixel of the conventional three-pixel RGB liquid crystal panel into two different main pixel zone M and sub pixel zone S, while keeping the data signals R and G of the red sub pixel and the green sub pixel unchanged and to reset data parameters. The main pixel zone M and the sub pixel zone S are respectively connected to data signal lines to supply different data signals to the main pixel zone M and the sub pixel zone S in order to improve the issue of color shift at a large view angle. Compared to the red sub pixel and the green sub pixel, the blue pixel has least influence on the brightness and after resetting the grey levels, the potential risk of affecting the transmittance is reduced.

The embodiments illustrated above are not construed as limiting the scope of protection of the technical solutions. Modifications, equivalent substitutions, and improvements that are made without departing from the spirits and principles of the above-described embodiments are considered within the scope of protection of the technical solutions.

What is claimed is:

1. A pixel unit setting method for a liquid crystal panel, where the liquid crystal panel comprises a plurality of pixel units, each of the pixel units comprising a blue sub pixel, a red sub pixel, and a green sub pixel, the method comprising:

S10: solely dividing the blue sub pixel into a main pixel zone M and a sub pixel zone S, wherein an area ratio between the main pixel zone M and the sub pixel zone S is a:b;

S11: acquiring an actual brightness level Lvα for each grey level G of the blue sub pixel of the liquid crystal panel at a normal view angle α;

S12: acquiring an actual brightness level Lvβ for each grey level G of the blue sub pixel of the liquid crystal panel at an oblique view angle β;

S13: applying the following formulas to divide the actual brightness levels Lvα and Lvβ according to the area ratio between the main pixel zone M and the sub pixel zone S:

$$LvM\alpha:LvS\alpha=a:b,\ LvM\alpha+LvS\alpha=Lv\alpha;$$

$$LvM\beta:LvS\beta=a:b,\ LvM\beta+LvS\beta=Lv\beta;$$

acquiring actual brightness levels LvMα and LvMβ of the main pixel zone M for each grey level G at the normal view angle α and the oblique view angle β; and acquiring the actual brightness levels LvSα and LvSβ of the sub pixel zone S for each grey level G at the normal view angle α and the oblique view angle β;

S14: using the actual brightness levels Lvα(max) and Lvβ(max) of the maximum grey level max that are acquired in Steps S11 and S12, in combination with the formulas gamma(γ) and $(G/max)^{\gamma}$=LvG/Lv(max), to calculate the theoretic brightness levels LvGxα and LvGxβ of the blue sub pixel of the liquid crystal panel for grey level G at the normal view angle α and the oblique view angle β;

S15: determining a grey level Gx of the blue sub pixel and grey levels to be fed to the main pixel zone M and the sub pixel zone S being respectively Gmx and Gsx, and applying the following formulas according to the actual brightness levels LvMα and LvMβ and LvSα and LvSβ acquired in Step S13 and the theoretic brightness levels LvGxα and LvGxβ acquired in Step S14:

$$\Delta 1=LvM\alpha+LvS\alpha-LvGx\alpha;\ \Delta 2=LvM\beta+LvS\beta-LvGx\beta;\ y=\Delta 1^2+\Delta 2^2;$$

wherein multiple trials of different value combinations of Gmx and Gsx are applied to calculate y and when y is minimum, the corresponding grey levels Gmx and Gsx are set to be the grey levels to be fed to the main pixel zone M and the sub pixel zone S for the grey level of the blue sub pixel being of the grey level Gx; and S16: repeating Step S15 for each grey level of the blue sub pixel of the pixel unit so as to acquire the grey levels to be fed to the main pixel zone M and the sub pixel zone S for all the grey levels of the pixel unit;

wherein data signals of the red sub pixel and the green sub pixel are kept unchanged and intact during the resetting of data parameters of the blue sub pixel to the grey levels Gmx and Gsx that provide the minimum of y.

2. The pixel unit setting method for the liquid crystal panel as claimed in claim 1, wherein the normal view angle α is 0° and the oblique view angle β is 30 to 80°.

3. The pixel unit setting method for the liquid crystal panel as claimed in claim 1, wherein grey levels of the liquid crystal panel comprise 256 grey levels from 0 to 255 of which a highest grey level is 255.

4. The pixel unit setting method for the liquid crystal panel as claimed in claim 1, wherein the step of acquiring the actual brightness level Lvα of the blue sub pixel of the liquid crystal panel for each grey level G at the normal view angle α comprises:

directly measuring the gamma curve at the normal view angle α; and determining the actual brightness level Lvα from the gamma curve.

5. The pixel unit setting method for the liquid crystal panel as claimed in claim 4, wherein the step of acquiring the actual brightness level of the blue sub pixel of the liquid crystal panel for each grey level G at the oblique view angle β comprises:

directly measuring the gamma curve Lvβ at the oblique view angle β; and determining the actual brightness level Lvβ from the gamma curve.

6. The pixel unit setting method for the liquid crystal panel as claimed in claim 1, wherein the main pixel zone M and the sub pixel zone S of the blue sub pixel are individually connected to data lines that supply data signals.

7. The pixel unit setting method for the liquid crystal panel as claimed in claim 1, wherein for the main pixel zone M and the sub pixel zone S in the brightness curve Gamma (γ) at the oblique view angle, γ=2.2.

8. A pixel unit setting method for a liquid crystal panel, the liquid crystal panel comprising a plurality of pixel units, each of the pixel units at least comprising a blue sub pixel, a red sub pixel, and a green sub pixel, the method comprising:

solely dividing the blue sub pixel into a main pixel zone M and a sub pixel zone S according to a predetermined area ratio;

acquiring actual brightness levels of each grey level G of the blue sub pixel of the liquid crystal panel at a normal view angle α and an oblique view angle β;

dividing the actual brightness levels according to the area ratio of the main pixel zone M and the sub pixel zone S and establishing a corresponding relationship between the grey levels and the actual brightness levels of the main pixel zone M and the sub pixel zone S; and acquiring the actual brightness levels of the highest grey levels and calculating a theoretic brightness level of each grey level, and determining and setting a combination of a first grey level value and a second grey level value respectively fed to the main pixel zone M and the sub pixel zone S of one of the pixel units so that a sum of differences between the actual brightness levels and the theoretic brightness levels of the pixel at the normal view angle and the oblique view angle is minimized through multiple trials of different combinations of the first grey level value and the second grey level value to identify the combination of the first grey level value and the second grey level value that minimizes the sum of differences between the actual brightness levels and the theoretic brightness levels, while data parameters of the red sub pixel and the green sub pixel remain unchanged and intact.

9. A liquid crystal display of the liquid crystal panel as claimed in claim 8, wherein the liquid crystal panel further comprises a gate controller and a source controller, the gate controller supplying gate signals through a plurality of gate lines to the pixel units, the source controller supplying data signals through a plurality of data lines to the pixel units.

10. A liquid crystal display, comprising a backlight module and a liquid crystal panel opposite to the backlight module, the backlight module supplying light to the liquid crystal panel, the liquid crystal panel comprising a plurality of the pixel units, wherein each of the pixel units comprises a blue sub pixel, a red sub pixel, and a green sub pixel; and a method for the liquid crystal panel to set the pixel units comprises:

S10: solely dividing the blue sub pixel into a main pixel zone M and a sub pixel zone S, wherein an area ratio between the main pixel zone M and the sub pixel zone S is a:b;

S11: acquiring an actual brightness level Lvα for each grey level G of the blue sub pixel of the liquid crystal panel at a normal view angle α;

S12: acquiring an actual brightness level Lvβ for each grey level G of the blue sub pixel of the liquid crystal panel at an oblique view angle β;

S13: applying the following formulas to divide the actual brightness levels Lvα and Lvβ according to the area ratio between the main pixel zone M and the sub pixel zone S:

$$LvM\alpha:LvS\alpha=a:b,\ LvM\alpha+LvS\alpha=Lv\alpha;$$

$$LvM\beta:LvS\beta=a:b,\ LvM\beta+LvS\beta=Lv\beta;$$

acquiring actual brightness levels LvMα and LvMβ of the main pixel zone M for each grey level G at the normal view angle α and the oblique view angle β; and acquiring the actual brightness levels LvSα and LvSβ of the sub pixel zone S for each grey level G at the normal view angle α and the oblique view angle β;

S14: using the actual brightness levels Lvα(max) and Lvβ(max) of the maximum grey level max that are acquired in Steps S11 and S12, in combination with the formulas gamma(γ) and $(G/max)^{\gamma}=LvG/Lv(max)$, to calculate the theoretic brightness levels LvGxα and LvGxβ of the blue sub pixel of the liquid crystal panel for grey level G at the normal view angle α and the oblique view angle β;

S15: determining a grey level Gx of the blue sub pixel and grey levels to be fed to the main pixel zone M and the sub pixel zone S being respectively Gmx and Gsx, and applying the following formulas according to the actual brightness levels LvMα and LvMβ and LvSα and LvSβ acquired in Step S13 and the theoretic brightness levels LvGxα and LvGxβ acquired in Step S14:

$$\Delta1=LvM\alpha+LvS\alpha-LvGx\alpha;\ \Delta2=LvM\beta+LvS\beta-LvGx\beta;$$
$$y=\Delta1^2+\Delta2^2;$$

wherein multiple trials of different value combinations of Gmx and Gsx are applied to calculate y and when y is minimum, the corresponding grey levels Gmx and Gsx are set to be the grey levels to be fed to the main pixel zone M and the sub pixel zone S for the grey level of the blue sub pixel being of the grey level Gx;

S16: repeating Step S15 for each grey level of the blue sub pixel of the pixel unit so as to acquire the grey levels to be fed to the main pixel zone M and the sub pixel zone S for all the grey levels of the pixel unit;

wherein data signals of the red sub pixel and the green sub pixel are kept unchanged and intact during the resetting of data parameters of the blue sub pixel to the grey levels Gmx and Gsx that provide the minimum of y.

* * * * *